US011702924B2

(12) United States Patent
Liu et al.

(10) Patent No.: US 11,702,924 B2
(45) Date of Patent: Jul. 18, 2023

(54) DETERMINATION OF STIMULATED RESERVOIR VOLUME AND ESTIMATED ULTIMATE RECOVERY OF HYDROCARBONS FOR UNCONVENTIONAL RESERVOIRS

(71) Applicant: ARAMCO SERVICES COMPANY, Houston, TX (US)

(72) Inventors: Hui-Hai Liu, Houston, TX (US); Jilin Zhang, Houston, TX (US); Huseyin Onur Balan, Katy, TX (US); Feng Liang, Houston, TX (US)

(73) Assignee: ARAMCO SERVICES COMPANY, Houston, TX (US)

( * ) Notice: Subject to any disclaimer, the term of this patent is extended or adjusted under 35 U.S.C. 154(b) by 212 days.

(21) Appl. No.: 17/144,677

(22) Filed: Jan. 8, 2021

(65) Prior Publication Data

US 2022/0220839 A1 Jul. 14, 2022

(51) Int. Cl.
*E21B 43/26* (2006.01)
*E21B 47/003* (2012.01)

(52) U.S. Cl.
CPC ..... *E21B 47/003* (2020.05); *E21B 43/26* (2013.01); *E21B 2200/20* (2020.05)

(58) Field of Classification Search
CPC .... E21B 47/003; E21B 43/26; E21B 43/2605; E21B 43/2607; E21B 43/27; E21B 2200/20; E21B 33/00; E21B 43/00
See application file for complete search history.

(56) References Cited

U.S. PATENT DOCUMENTS 6,904,366 B2 6/2005 Patzek et al.
7,369,979 B1 5/2008 Spivey
(Continued)

FOREIGN PATENT DOCUMENTS

CN 105507893 A * 4/2016 ..... E21B 43/26
CN 109594968 A * 4/2019 ..... E21B 43/26
(Continued)

OTHER PUBLICATIONS

International Search Report and Written Opinion issued in Application No. PCT/US2022/011653, dated May 13, 2022 (13 pages).
(Continued)

*Primary Examiner* — Tarun Sinha
*Assistant Examiner* — James I Burris
(74) *Attorney, Agent, or Firm* — Osha Bergman Watanabe & Burton LLP

(57) ABSTRACT

A method for determining SRV and EUR includes: monitoring an amount and a density of a hydrocarbon fluid produced from the production well; obtaining a cumulative amount of the fluid that has accumulated from a beginning of production; obtaining a relationship between the cumulative amount and a square root of the time; determining a deviation point where the relationship changes from linear to non-linear; determining a deviation amount of the fluid corresponding to the deviation point; determining a first density of the hydrocarbon fluid at the beginning of production, a second density at a pore pressure equal to a bottom hole pressure in the production well, a first porosity at the beginning of production, and a second porosity for a pore pressure equal to the bottom hole pressure; and determining SRV and the EUR based on the deviation amount, the first and second densities, and the first and second porosities.

2 Claims, 4 Drawing Sheets

(56) References Cited

U.S. PATENT DOCUMENTS

| | | | | |
|---|---|---|---|---|
| 10,815,778 | B1 * | 10/2020 | Hou | G06F 17/11 |
| 2017/0051598 | A1 * | 2/2017 | Ouenes | E21B 43/26 |
| 2018/0293336 | A1 | 10/2018 | Tao | |
| 2021/0002999 | A1 * | 1/2021 | Yue | E21B 43/00 |

FOREIGN PATENT DOCUMENTS

| | | | | | |
|---|---|---|---|---|---|
| CN | 111396013 | A | * | 7/2020 | E21B 43/26 |
| CN | 111927417 | A | * | 11/2020 | |
| WO | WO-2016118807 | A1 | * | 7/2016 | E21B 41/0092 |
| WO | WO-2017041074 | A1 | * | 3/2017 | E21B 43/26 |

OTHER PUBLICATIONS

D. Fan and A. Ettehadtavakkol; "Transient shale gas flow model", Journal of Natural Gas Science and Engineering; vol. 33; Jul. 2016; pp. 1353-1363 (11 pages).

H. Wang; "What Factors Control Shale Gas Production and Production Decline Trend in Fractured Systems: A Comprehensive Analysis and Investigation", arXiv:1710.1146v1; Cornell University Library; Oct. 26, 2017 (13 pages).

B. Song; "Rate-Normalized Pressure Analysis for Determination of Shale Gas Well Performance", SPE 144031; Proceedings of the 2011 SPE North American Unconventional Gas Conference and Exhibition; Jun. 16, 2011; pp. 1-14 (14 pages).

Saputra, Wardana et al., "Physical Scaling of Oil Production Rates and Ultimate Recovery from All HorizontalWells in the Bakken Shale", Energies, MDPI, vol. 13, No. 2052, Apr. 2020 pp. 1-29 (29 pages).

Mahmoud, Mohamed et al.,"An integrated workflow to perform reservoir and completion parametric study on a shale gas reservoir", Journal of Petroleum Exploration and Production Technology, Springer, vol. 10, Jan. 2020, pp. 1497-1510 (14 pages).

"Unconventional Reservoir Theory", IHS Harmony, IHS Markit Ltd, 2016, revised Feb. 24, 2020, Accessed Jan. 8, 2021, URL: <https://www.ihsenergy.ca/support/documentation_ca/Harmony/content/html_files/reference_material/analysis_method_theory/unconventional_reservoir_theory.htm#Eq2> (19 pages).

"Unconventional Resources", Dynamic Data Analysis, KAPPA, V5.12.01, Jan. 2020, pp. 1-92 (92 pages).

Behmanesh, Hamid, "Rate-Transient Analysis of Tight Gas Condensate and Black Oil Wells Exhibiting Two-phase Flow". Ph.D Thesis, University of Calgary, Jan. 2016 (293 pages).

* cited by examiner

DETERMINATION OF STIMULATED RESERVOIR VOLUME AND ESTIMATED ULTIMATE RECOVERY OF HYDROCARBONS FOR UNCONVENTIONAL RESERVOIRS

BACKGROUND

In the oil and gas industry, reservoirs are often classified into conventional reservoirs and unconventional reservoirs based on the permeability of the reservoir rock and the viscosity of the fluid. Compared to conventional reservoirs, unconventional reservoirs typically have low permeability and high viscosity. Because of these characteristics, hydraulic fracturing is commonly utilized in unconventional reservoirs to enhance hydrocarbon production.

SUMMARY

In one aspect, the disclosure relates to a method for determining stimulated reservoir volume (SRV) and estimated ultimate recovery (EUR) in a reservoir that utilizes a hydraulic fracture in a production well. The method includes: monitoring, via a monitor disposed at a well head of the reservoir, an amount and a density of a hydrocarbon fluid that is produced from the production well; obtaining a cumulative amount of the hydrocarbon fluid that has accumulated over time from a beginning of reservoir production; obtaining a relationship between the cumulative amount and a square root value of the time; determining a deviation point where the relationship changes from linear to non-linear; determining a deviation amount of the hydrocarbon fluid that corresponds to the deviation point; determining a first density of the hydrocarbon fluid under reservoir condition at the beginning of reservoir production, a second density of the hydrocarbon fluid at a pore pressure equal to a bottom hole pressure in the production well, a first porosity under reservoir condition at the beginning of reservoir production, and a second porosity of the reservoir for a pore pressure equal to the bottom hole pressure in the production well; and determining the SRV and the EUR based on the deviation amount, the first density, the second density, the first porosity, and the second porosity.

In one aspect, the disclosure relates to a system for determining stimulated reservoir volume (SRV) and estimated ultimate recovery (EUR) in a reservoir that utilizes a hydraulic fracture in a production well. The system includes: a monitor disposed at a well head of the reservoir; a sensor; and a processor. The monitor monitors an amount and a density of a hydrocarbon fluid that is produced from the production well. The sensor measures bottom hole pressure in the production well. The processor determines, based on measurement data, a first density of the hydrocarbon fluid under reservoir condition at the beginning of reservoir production, a second density of the hydrocarbon fluid at a pore pressure equal to the bottom hole pressure in the production well, a first porosity under reservoir condition at the beginning of reservoir production, and a second porosity of the reservoir for a pore pressure equal to the bottom hole pressure in the production well. The processor also obtains a cumulative amount of the hydrocarbon fluid that has accumulated over time from the beginning of reservoir production. The processor further obtains a relationship between the cumulative amount and a square root value of the time. The processor determines a deviation point where the relationship changes from linear to non-linear. The processor determines a deviation amount of the hydrocarbon fluid that corresponds to the deviation point. The processor also calculates the SRV and the EUR based on the deviation amount, the first density, the second density, the first porosity, and the second porosity.

Other aspects and advantages of the invention will be apparent from the following description and the appended claims.

DETAILED DESCRIPTION

Figure 1:
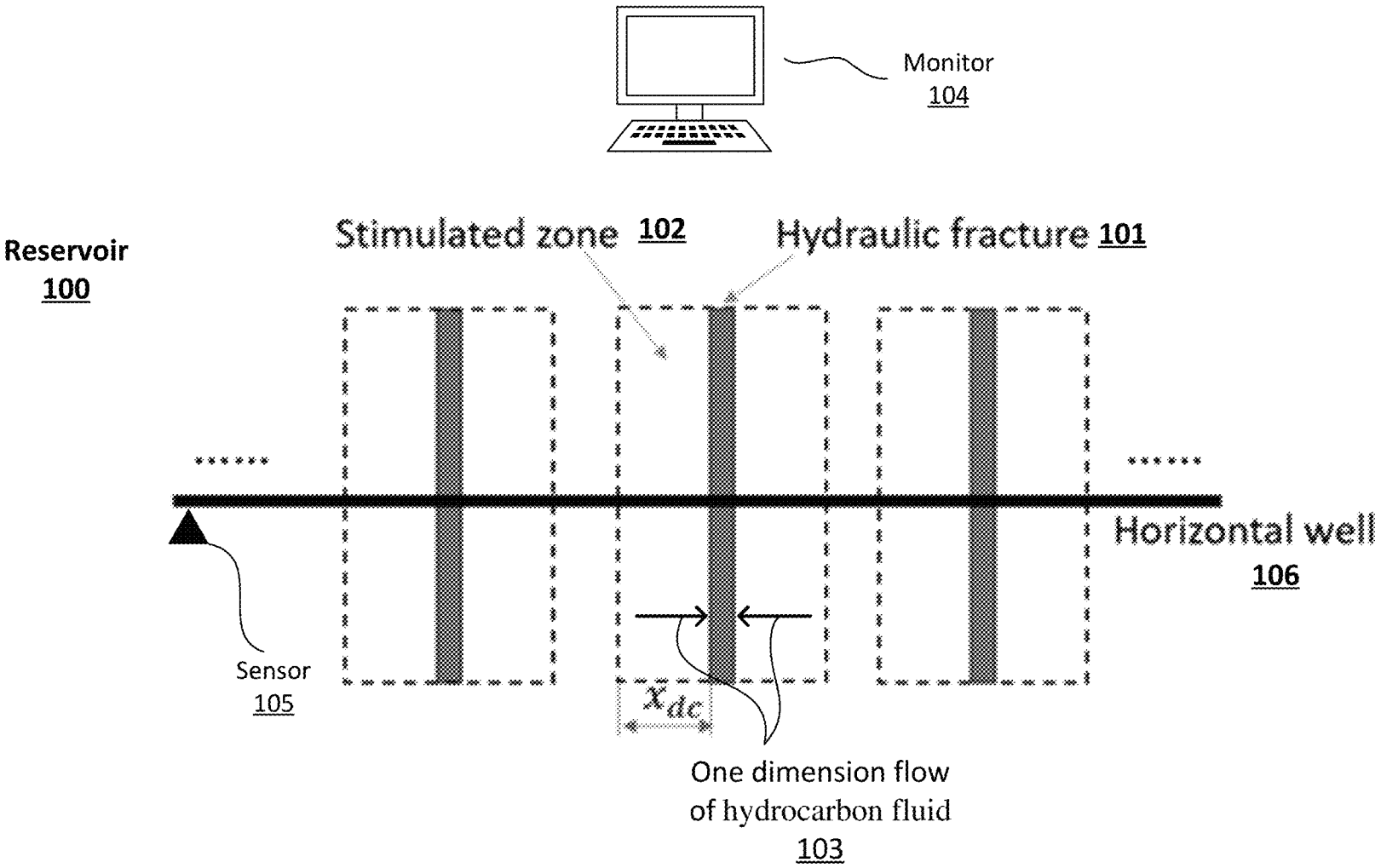
FIG. 1 briefly shows a reservoir with a plurality of hydraulic fractures according to one or more embodiments.

Specific embodiments of the invention will now be described in detail with reference to the accompanying figures. Like elements in the various figures are denoted by like reference numerals for consistency. Like elements may not be labeled in all figures for the sake of simplicity.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers does not imply or create a particular ordering of the elements or limit any element to being only a single element unless expressly disclosed, such as by the use of the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-4, any component described with regard to a figure, in various embodiments of the invention, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments of the invention, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "a horizontal beam" includes reference to one or more of such beams.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that, one or more of the steps shown in the flowcharts may be omitted, repeated, and/or performed in a different order than the order shown. Accordingly, the scope of the invention should not be considered limited to the specific arrangement of steps shown in the flowcharts.

Although multiple dependent claims are not introduced, it would be apparent to one of ordinary skill that the subject matter of the dependent claims of one or more embodiments may be combined with other dependent claims.

As discussed above, the hydraulic fracturing process enhances the hydrocarbon production. Specifically, the enhancement may be achieved by (1) increasing the reservoir contact area characterized by the surface area of the created hydraulic fractures and (2) enhancing the reservoir permeability in zones stimulated by the fracturing process on both sides of hydraulic fractures. The volume of the stimulated zone is referred to as SRV. The EUR from a production well is closely related to SRV because the recovery of hydrocarbon resources is mainly from the SRV in practice for unconventional reservoirs.

SRV and EUR are important parameters for the completion, production, and management of unconventional reservoirs. A larger SRV indicates that the fracturing process is more efficient. The value of EUR indicates how much hydrocarbon can be eventually recovered from a production well.

FIG. 1 shows a reservoir 100 with a horizontal well 106, a plurality of hydraulic fractures 101 and their respective stimulated zones 102. Because hydraulic fracture permeability is much higher than the reservoir permeability, zero flow resistance is considered within the hydraulic fracture 101. In this case, the production process may be presented by a one-dimensional flow of hydrocarbon fluid 103 from the reservoir 100 to the hydraulic fractures 101.

In one or more embodiments, a monitor 104 is disposed at disposed at a well head (e.g., ground surface) of the reservoir 100, and a sensor 105 is disposed at the bottom of the production well. The monitor 104 monitors the amount of a hydrocarbon fluid 103 that is produced from the production well, and also monitors a density of the hydrocarbon fluid 103. The sensor 105 measures a number of parameters in the reservoir 100 or at the surface of the hydraulic fracture 101. These parameters may include bottom hole pressure in the production well. In some embodiments, the monitor 104 may be coupled with a processor to record the amount of the hydrocarbon fluid 103 that has accumulated over time from a beginning of reservoir production.

The one-dimensional flow process of hydrocarbon fluid 103 may be described by the mass balance of hydrocarbon fluids in the stimulated zone as $$\frac{\partial(\rho\varphi)}{\partial t} = \frac{\partial}{\partial x}\left[\left(\frac{k\rho}{\mu}\right)\frac{\partial p}{\partial x}\right]. \tag{1}$$

In equation (1), ρ is fluid density, φ is porosity, t is time, k is permeability, μ is viscosity, p is fluid pressure in the reservoir 100 (or pore pressure), μ is viscosity, and x is spatial coordinate with the direction perpendicular to the hydraulic fracture surface and a zero value at the fracture surface.

Defining $$m = \rho\varphi, \tag{2}$$

and $$D = \frac{k\rho}{\mu}\frac{dp}{dm}, \tag{3}$$

equation (1) can be rewritten as $$\frac{\partial m}{\partial t} = \frac{\partial}{\partial x}\left[D\frac{\partial m}{\partial x}\right]. \tag{4}$$

The initial condition and the boundary condition can be represented by equations (5-1)-(5-3):

$$m(x,t)=m_i\ (t=0) \tag{5-1},$$

$$m(x,t)=m_w\ (x=0;\ t>0) \tag{5-2},$$

$$m(x,t)=m_i\ (x\rightarrow\infty) \tag{5-3}.$$

In equations (5-1)-(5-3), $m_i$ and $m_w$ represent the initial reservoir pore pressure and the bottom hole pressure in a production well, respectively.

With the initial and boundary conditions given in equations (5-1)-(5-3), equation (4) can be solved according to Hamid Behmanesh, 2016, "Rate-transient analysis of tight gas condensate and black oil wells exhibiting two-phase flow," Ph.D thesis, University of Calgary ("Behmanesh 2016" hereinafter):

$$\tilde{m} = erfc\left(\frac{x}{2\sqrt{Dt}}\right), \tag{6-1}$$

where $$\tilde{m} = \frac{m_i - m}{m_i - m_w}. \tag{6-2}$$

Application of Darcy's law at the hydraulic fracture surface gives the mass flow rate for the production well:

$$q = -A_f\left(\left(\frac{k\rho}{\mu}\right)\frac{\partial p}{\partial x}\right)_{x=0} = -A_f\left(D\frac{\partial m}{\partial x}\right)_{x=0}, \tag{7}$$

where $A_f$ is the total area of hydraulic fracture surface.

Combining equations (6-1), (6-2), and (7) gives $$q = \frac{A_f}{\sqrt{\pi}}(m_i - m_w)\sqrt{\frac{D}{t}}. \tag{8}$$

Integration of equation (8) with respect to time t yields the accumulative mass flow rate:

$$Q = \frac{2A_f}{\sqrt{\pi}}(m_i - m_w)\sqrt{Dt}. \quad (9)$$

During the hydrocarbon production, pore pressure decreases in the reservoir 100 as time and distance from the surface of hydraulic fracture 101 increase. The distance between the front of pressure disturbance and the hydraulic fracture surface, $x_d$, is referred to as penetration depth herein. According to Behmanesh 2016, $$x_d = \sqrt{6Dt} \quad (10).$$

When the pressure depletion front reaches the boundary of the stimulated rock on the two sides of hydraulic fracture 101, the boundary condition defined in equation (5-3) is not valid any longer. In this case, the production data will deviate from equation (9). Using subscript c to denote the observations and related parameters for this deviation point, equations (9) and (10) at the deviation point become equations (11) and (12), respectively:

$$Q_c = \frac{2A_f}{\sqrt{\pi}}(m_i - m_w)\sqrt{Dt_c}, \quad (11)$$

$$x_{dc} = \sqrt{6Dt_c}. \quad (12)$$

Combining equations (11) and (12) gives $$Q_c = \frac{(2A_f x_{dc})(m_i - m_w)}{\sqrt{6\pi}}. \quad (13)$$

Note that SRV can be obtained as $$SRV = A_f x_{dc} \quad (14).$$

Based on equations (13) and (14), SRV can be calculated as $$SRV = \frac{\sqrt{1.5\pi}\, Q_c}{m_i - m_w}. \quad (15)$$

In addition, EUR can be obtained as $$EUR = SRV(m_i - m_w) \quad (16).$$

Based on equations (15) and (16), EUR can be calculated as $$EUR = \sqrt{1.5\pi}\, Q_c \quad (17).$$

In practice, using equations (15) and (17) to calculate SRV and EUR is relatively easy because the calculation involves a few observations. Also, the physical meaning of equation (15) is that the total volume of produced hydrocarbon fluid (when the pressure depletion front reaches the boundary of simulated reservoir rocks) is a certain fraction of the SRV. Equations (15) and (17) assume the constant pressure drawdown in a production well. This assumption is generally true after the early production stage. The derivation of equations (15) and (17) also assumes that D in equation (4) or equivalent parameters is constant. Behmanesh 2016 indicates that this a reasonable assumption when analyzing the production data as long as D or equivalent parameters are calculated at the average pore pressure of the pressure depletion zone in the reservoir 100. Behmanesh 2016 also suggests that the average pore pressure does not change over time for a constant pressure drawdown.

Furthermore, EUR is defined herein as the mass of hydrocarbons that can be ultimately recovered for a given pressure drawdown. In some situations, EUR may be limited by the ultimate production time (say, 20 years) or by the condition that the production rate must be higher than certain value before the production well is retired. In these cases, equation (17) gives the upper limits of the EUR values.

Figure 2:
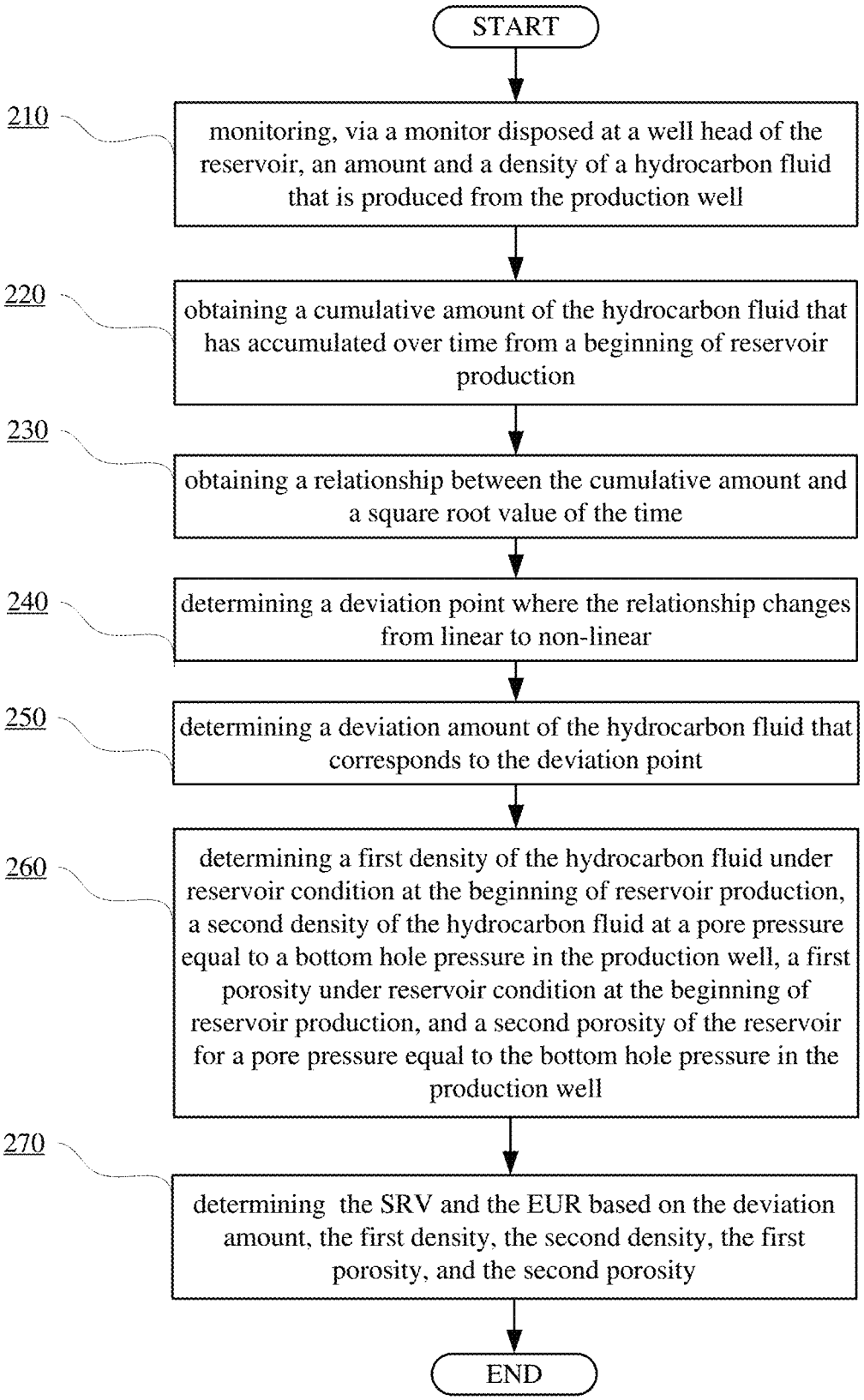
FIG. 2 is a flow chart of a method for determining SRV and EUR according to one or more embodiments.

Based on the above derivation, a method for determining SRV and EUR is described below with reference to FIG. 2.

Specifically, at step 210, the method uses a monitor, disposed at a well head of the reservoir, to monitor an amount and a density of a hydrocarbon fluid that is produced from the production well. The amount may be measured in terms of mass. The monitor may be coupled with a processor that analyzes reservoir data in a laboratory to generate measurement data.

At step 220, based on the data obtained from the monitor, the method obtains a cumulative amount of the hydrocarbon fluid that has accumulated over time from a beginning of reservoir production. If the hydrocarbon fluid includes both oil and gas, the cumulative amount at a given time is the sum of cumulative mass flow rates for oil and gas.

At step 230, a relationship between the cumulative amount and a square root value of the time is obtained. The relationship may be plotted for visual analysis as later described with reference to FIG. 3.

At step 240, a deviation point where the relationship changes from linear to non-linear is determined. A processor may be used for the determination.

At step 250, a deviation amount of the hydrocarbon fluid that corresponds to the deviation point is determined. The deviation amount may simply correspond to the cumulative amount, which is one of the two coordinates of the plotted relationship, of the deviation point.

At step 260, based on the measurement data, the method determines a first density of the hydrocarbon fluid under reservoir condition at the beginning of reservoir production, a second density of the hydrocarbon fluid at a pore pressure equal to a bottom hole pressure in the production well, a first porosity under reservoir condition at the beginning of reservoir production, and a second porosity of the reservoir for a pore pressure equal to the bottom hole pressure in the production well. These determination results may be used to obtain the initial condition $m_i$ and the boundary condition described in equations (5-1)-(5-3).

At step 270, SRV and EUR are determined based on the deviation amount, the first density, the second density, the first porosity, and the second porosity. Specifically, the deviation amount may correspond to $Q_c$ in equations (15) and (17), and the first density, the second density, the first porosity, and the second porosity may be used to calculate $m_i$ and $m_w$ according to equations (2)-(5-3). As such, SRV and EUR may be calculated in accordance with equations (15) and (17).

One of ordinary skill in the art would have understood that steps 210-270 do not necessarily have to be executed in the order according to the description above. For example, step 260 may be executed prior to or in parallel with any or all of steps 210-250.

Figure 3:
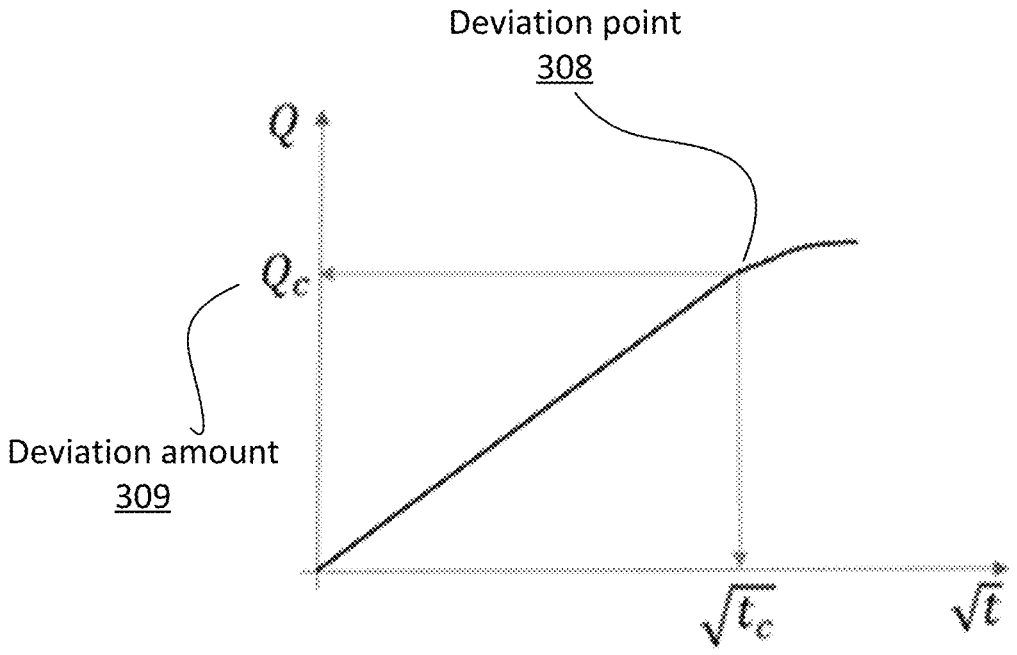
FIG. 3 is a plot of the relationship between the cumulative amount and a square root value of the time according to one or more embodiments.

FIG. 3 shows a plot of the relationship between the cumulative amount and a square root value of the time according to one or more embodiments. As shown in FIG. 3, each point on the curve has two coordinates: Q, which represents the cumulative amount, and $\sqrt{t}$, which represents the square root of time. The point where the curve changes from linear to non-linear is the deviation point 308, represented as ($Q_c$, $\sqrt{t_c}$), where $Q_c$ represents a deviation amount 309. Accordingly, before the deviation point 308, the curve can be represented as $$Q=a\sqrt{t}+b \tag{18}$$

where a and b are constants.

In practice, b is generally not zero because of the effects of well bore storage and cleaning up of hydraulic fractures at the early time of production. However, for the purpose of modeling, equation (19) may be used to determine $Q_c$.

$$Q_c=a\sqrt{t_c} \tag{19}$$

Figure 4:
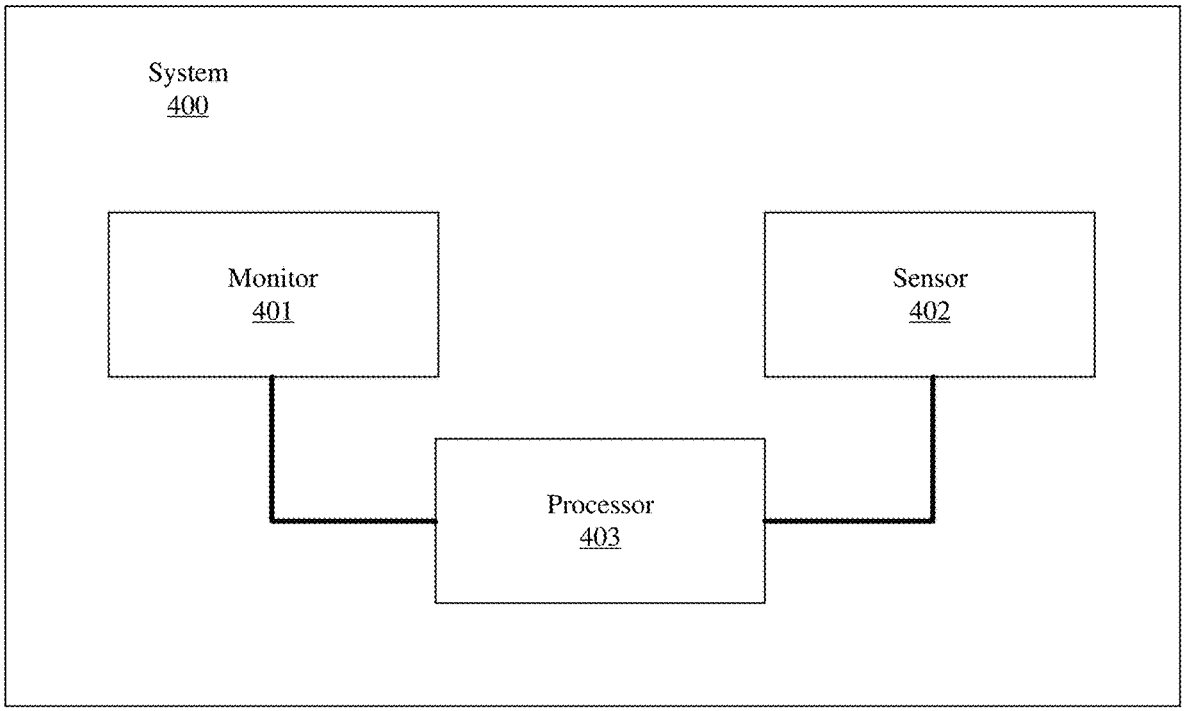
FIG. 4 is a block diagram of a system or determining SRV and EUR according to one or more embodiments.

The above calculation may be implemented in a system for determining SRV and EUR. FIG. 4 is a block diagram of such a system according to one or more embodiments.

As shown in FIG. 4, the system 400 includes a monitor 401, such as a computing equipment having a screen, that monitors an amount and a density of a hydrocarbon fluid produced from the production well. The system 400 also includes a sensor 402, which may be a single sensor device or a group of separate sensor devices, that measures bottom hole pressure in the production well. Further, the system 400 includes a processor 403, coupled to the monitor 401 and the sensor 402. The processor 403 may obtain a cumulative amount based on the output of the monitor 401, and obtain the relationship between the cumulative amount and a square root value of the time. The processor 403 may thus determine the deviation point and the corresponding deviation amount. In addition, the processor 403 determines, based on measurement data from the monitor 401 and the sensor 402, a first density of the hydrocarbon fluid under reservoir condition at the beginning of reservoir production, a second density of the hydrocarbon fluid at a pore pressure equal to the bottom hole pressure in the production well, a first porosity under reservoir condition at the beginning of reservoir production, and a second porosity of the reservoir for a pore pressure equal to the bottom hole pressure in the production well. Based on the deviation amount, the first and second densities, and the first and second porosities, the processor 403 may determine SRV and EUR as described above.

There are many technologies that may be utilized to measure the parameters described in the previous paragraph. For example, in some embodiments, the monitor 401 may be connected to a flow meter disposed on a pipeline so as to monitor the flow rate of the hydrocarbon fluid, and may be connected to laboratory equipment so as to monitor the density of the hydrocarbon fluid. Additionally, the first and second porosities may be measured using technologies based on gamma ray emission, neutron emission, or nuclear magnetic resonance. Other technologies that are widely used in the industry are not enumerated here.

Embodiments described above provide a method and a system for determining SRV and EUR based on early production data, reservoir porosity, and hydrocarbon fluid densities at both the initial reservoir pore pressure and the bottom hole pressure. Compared to conventional technologies, embodiments disclosed herein may simplify the hardware and software implementations for SRV and EUR determination, and thus may improve the effectiveness and efficiency of reservoir management.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method, comprising:

creating a plurality of hydraulic fractures using a horizontal well in an unconventional reservoir, wherein the unconventional reservoir comprises a plurality of stimulated zones;

producing, using a production well comprising the horizontal well, hydrocarbon fluid from the unconventional reservoir;

monitoring, via a monitor disposed at a well head of the production well in the unconventional reservoir, an amount of the hydrocarbon fluid that is produced from the production well, and monitoring a density of the hydrocarbon fluid;

obtaining a cumulative amount of the hydrocarbon fluid that has accumulated over time from a beginning of reservoir production;

obtaining a relationship between the cumulative amount of the hydrocarbon fluid as a function of production time and a square root value of the production time in the function;

determining, by the monitor, a deviation point where the relationship changes from linear to non-linear;

determining, by the monitor, a deviation amount of the hydrocarbon fluid that corresponds to the deviation point;

determining, by the monitor, a first density of the hydrocarbon fluid under a reservoir condition of the hydrocarbon fluid being produced at the production well, a second density of the hydrocarbon fluid at a pore pressure equal to a bottom hole pressure in the production well, a first porosity under reservoir condition at the beginning of reservoir production, and a second porosity of the reservoir for a pore pressure equal to the bottom hole pressure in the production well;

determining, by the monitor, stimulated reservoir volume (SRV) and estimated ultimate recovery (EUR) for the unconventional reservoir based on the deviation amount, the first density, the second density, the first porosity, and the second porosity, wherein the SRV is calculated as $$SRV = \frac{\sqrt{1.5\pi}\,Q_c}{m_i - m_w},$$

where $Q_c$ is the deviation amount, $m_i$ is a product of the first density and the first porosity, and $m_w$ is a product of the second density and the second porosity, and wherein the EUR is calculated as $$EUR=\sqrt{1.5\pi}Q_c,$$

where $Q_c$ is the deviation amount; and managing, at the production well using the monitor, the hydrocarbon fluid based on the SRV and the EUR of the unconventional reservoir.

2. The method according to claim 1, further comprising plotting the relationship between the cumulative amount and the square root value of the time.

* * * * *